US006511567B1

(12) United States Patent
Ruggie et al.

(10) Patent No.: US 6,511,567 B1
(45) Date of Patent: Jan. 28, 2003

(54) COMPOSITE BUILDING COMPONENTS AND METHOD OF MAKING SAME

(75) Inventors: Mark A. Ruggie, Franklin, IL (US); Brian Bonomo, Oak Park, IL (US); Lemuel Lee Braddock, Huntlin, IL (US); Toplica Koledin, Darien, IL (US); Bei-Hong Liang, Naperville, IL (US); Steven K. Lynch, St. Charles, IL (US); Kathleen Nemivant, Forest Park, IL (US); Beverly Pearce, Winchester, VA (US); Mark Allen Weldon, Elburn, IL (US)

(73) Assignee: International Paper Company, Purchase, NY (US)

( * ) Notice: Subject to any disclaimer, the term of this patent is extended or adjusted under 35 U.S.C. 154(b) by 0 days.

(21) Appl. No.: 09/538,766

(22) Filed: Mar. 30, 2000

Related U.S. Application Data

(60) Provisional application No. 60/127,120, filed on Mar. 31, 1999.

(51) Int. Cl.[7] ..... B32B 3/23; B32B 21/02; B32B 21/13

(52) U.S. Cl. ..... 156/205; 156/207; 156/210; 156/292; 156/296; 156/581; 264/109

(58) Field of Search ..... 156/62.2, 196, 156/208, 219, 296, 580, 292, 207, 210, 581; 204/109; 428/170, 174, 182, 156, 163, 184

(56) References Cited

U.S. PATENT DOCUMENTS

| | | | | |
|---|---|---|---|---|
| 2,717,420 | A | 9/1955 | Roy | 18/12 |
| 3,061,878 | A | 11/1962 | Chapman | 18/17 |
| 3,179,983 | A | 4/1965 | Webber et al. | 20/5 |
| 3,354,248 | A | 11/1967 | Haas et al. | 264/119 |
| 3,359,929 | A | 12/1967 | Carlson | 108/58 |
| 3,423,267 | A | 1/1969 | Munk | 156/214 |
| 3,709,646 | A | 1/1973 | Munk | 425/217 |
| 3,720,176 | A | 3/1973 | Munroe | 108/58 |
| 3,764,645 | A | 10/1973 | Munk | 264/112 |

(List continued on next page.)

FOREIGN PATENT DOCUMENTS

| | | | | |
|---|---|---|---|---|
| CA | 2175865 | | 11/1997 | E04B/2/80 |
| DE | 835 053 | | 3/1952 | 37/201 |
| EP | 0049299 | A1 * | 3/1980 | |
| EP | 49 299 | A1 | 4/1982 | |
| EP | 49299 | B1 | 2/1985 | |

OTHER PUBLICATIONS

Koch et al., "Shaping–Lathe Headrig Yields Solid and Molded–Flake Hardwood Products", *Forest Products Journal*(1978), vol. 28, No. 10, pp. 53–61.

(List continued on next page.)

*Primary Examiner*—Sam Chuan Yao
(74) *Attorney, Agent, or Firm*—Liniak, Berenato & White, LLC

(57) ABSTRACT

A composite building component, including a non-planar molded composite web having two outer zones and two angled zones wherein the caliper of the angled zones differs from the caliper of at least one of the outer zones, and a flange disposed on an outer surface of an outer zone.

27 Claims, 5 Drawing Sheets

U.S. PATENT DOCUMENTS

| | | | | | |
|---|---|---|---|---|---|
| 3,800,485 | A | | 4/1974 | Yates | 52/90 |
| 3,810,798 | A | | 5/1974 | McCoy | 156/62.2 |
| 3,844,231 | A | | 10/1974 | Peacock | 108/107 |
| 3,861,326 | A | | 1/1975 | Brown | 108/51 |
| 3,868,300 | A | | 2/1975 | Wheeler | 162/124 |
| 3,884,749 | A | | 5/1975 | Pankoke | 156/501 |
| 4,061,813 | A | * | 12/1977 | Geimer et al. | 108/51.11 |
| 4,073,851 | A | | 2/1978 | Munk | 264/109 |
| 4,078,030 | A | | 3/1978 | Munk et al. | 264/109 |
| 4,084,996 | A | | 4/1978 | Wheeler | 156/257 |
| 4,127,636 | A | | 11/1978 | Flanders | 264/113 |
| 4,150,186 | A | | 4/1979 | Kazama | 428/140 |
| 4,191,606 | A | | 3/1980 | Evans | 156/288 |
| 4,195,462 | A | | 4/1980 | Keller et al. | 52/690 |
| 4,221,751 | A | | 9/1980 | Haataja et al. | 264/119 |
| 4,248,163 | A | | 2/1981 | Caughey | 108/53.3 |
| 4,248,820 | A | | 2/1981 | Haataja | 264/113 |
| 4,364,984 | A | | 12/1982 | Wentworth | 428/106 |
| 4,378,265 | A | | 3/1983 | Kiss | 156/242 |
| 4,387,546 | A | | 6/1983 | Kurita et al. | 52/731 |
| 4,408,544 | A | | 10/1983 | Haataja | 108/53.3 |
| 4,415,516 | A | | 11/1983 | Krueger et al. | 264/112 |
| 4,428,791 | A | | 1/1984 | Reinke | 156/161 |
| 4,429,012 | A | | 1/1984 | Danko | 428/12 |
| 4,440,708 | A | | 4/1984 | Haataja et al. | 264/109 |
| 4,514,532 | A | | 4/1985 | Hsu et al. | 524/14 |
| 4,559,195 | A | | 12/1985 | Heggenstaller | 264/120 |
| 4,610,900 | A | | 9/1986 | Nishibori | 428/15 |
| 4,616,991 | A | | 10/1986 | Bach et al. | 425/396 |
| 4,635,421 | A | | 1/1987 | Newberg | 52/309.11 |
| 4,675,138 | A | | 6/1987 | Bach et al. | 264/294 |
| 4,734,236 | A | | 3/1988 | Davis | 264/112 |
| 4,790,966 | A | | 12/1988 | Sandberg et al. | 264/39 |
| 4,828,643 | A | | 5/1989 | Newman et al. | 156/328 |
| 4,830,929 | A | | 5/1989 | Ikeda et al. | 428/542.8 |
| 4,843,777 | A | | 7/1989 | Shimabukuro | 52/729 |
| 4,844,968 | A | | 7/1989 | Persson et al. | 428/181 |
| 4,865,788 | A | | 9/1989 | Davis | 264/112 |
| 4,904,517 | A | | 2/1990 | Lau et al. | 428/167 |
| 4,923,656 | A | | 5/1990 | Held | 264/70 |
| 4,960,553 | A | | 10/1990 | DeBruine et al. | 264/113 |
| 5,000,673 | A | | 3/1991 | Bach et al. | 425/396 |
| 5,028,371 | A | | 7/1991 | Bach | 264/112 |
| 5,028,374 | A | | 7/1991 | Imao et al. | 264/517 |
| 5,047,280 | A | | 9/1991 | Bach | 428/182 |
| 5,067,536 | A | | 11/1991 | Liska et al. | 144/361 |
| 5,142,994 | A | | 9/1992 | Sandberg et al. | 108/53.3 |
| 5,144,785 | A | | 9/1992 | Berglund | 52/730 |
| 5,164,255 | A | | 11/1992 | Weeks | 428/294 |
| 5,198,236 | A | | 3/1993 | Gunderson et al. | 425/80.1 |
| 5,210,990 | A | | 5/1993 | Kirk, Jr. | 52/664 |
| 5,223,326 | A | | 6/1993 | Bach | 428/182 |
| 5,242,735 | A | | 9/1993 | Blankenburg et al. | 428/116 |
| 5,273,806 | A | | 12/1993 | Lockshaw et al. | 428/167 |
| 5,290,621 | A | | 3/1994 | Bach et al. | 428/176 |
| 5,299,691 | A | | 4/1994 | Winski | 206/527 |
| 5,301,487 | A | | 4/1994 | Wiebe | 52/743 |
| 5,302,455 | A | | 4/1994 | DePetris et al. | 428/283 |
| 5,401,556 | A | | 3/1995 | Ishitoya et al. | 428/109 |
| 5,435,954 | A | | 7/1995 | Wold | 264/115 |
| 5,440,998 | A | | 8/1995 | Morgan, IV et al. | 108/51.1 |
| 5,443,891 | A | | 8/1995 | Bach | 428/182 |
| 5,471,806 | A | | 12/1995 | Rokhlin | 52/437 |
| 5,543,234 | A | | 8/1996 | Lynch et al. | 428/537.1 |
| 5,609,006 | A | | 3/1997 | Boyer | 52/731.9 |
| 5,633,053 | A | | 5/1997 | Lockshaw et al. | 428/33 |
| 5,653,080 | A | | 8/1997 | Bergeron | 52/729.4 |
| 5,664,393 | A | | 9/1997 | Veilleux et al. | 52/729.4 |
| 5,685,124 | A | | 11/1997 | Jandl, Jr. | 52/783.18 |
| 5,766,774 | A | | 6/1998 | Lynch et al. | 428/537.1 |
| 5,773,117 | A | | 6/1998 | Tognelli | 428/75 |
| 5,850,721 | A | | 12/1998 | Martin | 52/690 |
| 5,900,304 | A | * | 5/1999 | Owens | 428/167 |

OTHER PUBLICATIONS

McAlister, "Species and Core Joint Design Affect Tensile Strength and Stiffness of Composite Truss Lumber", *Forest Products Journal* (1986), vol. 36, No. 2, pp. 55–58.

Koenigshof, "Strength and Stiffness of Composite Floor Joists", *Forest Products Journal* (1986), vol. 36, No. 9, pp. 66–70.

Bach, "Manufacture of Corrugated Waferboard", *Forest Products Journal* (1989), vol. 39, No. 10, pp. 58–62.

Wavebord™ (Corrugated Waferboard) Business Opportunity Offer Document (1995), Alberta Research Council.

Bach et al., "An Innovative Stressed Skin Panel System Using Corrugated Wafeboard" Canadian Society for Civil Engineering, Annual Conference (1995).

SIM STUD Product Bulletin 05–950.342, BIOS + Value Inc., Mar. 1998.

International Search Report dated Jul. 13, 2000, in PCT/US 00/08520.

International Search Report dated Mar. 10, 2000, in PCT/US 99/26633.

Written Opinion dated Jul. 24, 2000, in PCT/US 99/26633.

* cited by examiner

COMPOSITE BUILDING COMPONENTS AND METHOD OF MAKING SAME

CROSS-REFERENCE TO RELATED APPLICATION

Priority under 35 U.S.C. §119(e) is claimed based on U.S. Provisional Application No. 60/127,120, filed Mar. 31, 1999, the disclosure of which is hereby incorporated by reference.

BACKGROUND OF THE INVENTION

1. Field of the Invention

The invention relates generally to man-made wood composite building components and their method of manufacture and assembly. More particularly, the invention relates to the production of composite lumber framing members such as studs and posts.

2. Description of Related Technology

In conventional building construction, building components such as walls, roofs, floors, and posts may be assembled from wooden framing members and sheathing. Framing members, e.g. lumber, may be produced from natural wood cut in standard sizes from trees such as aspen, spruce, pine, and fir. Sheathing, typically made of plywood or oriented strandboard (OSB), is fastened to the frame of a building component using mechanical fasteners and adhesives such as staples, nails, glue, screws or a urethane foam adhesive.

Traditional lumber produced from natural wood generally has shortcomings in consistency, availability, and cost. Likewise, building components made from traditional materials also have shortcomings in consistency, cost, and ease of assembly.

Conventional lumber from natural wood varies widely in quality. Because framing members, such as nominal 2×4s (actually measuring 1½ inches by 3½ inches), are cut whole from trees or logs as solid pieces, they can possess faults inherent in natural wood, such as knots and splits. Knots typically result in reduced strength in a piece of lumber, requiring a high design safety factor leading to inefficient use of materials. In addition, in a condition known as "waning," lumber cut from an outer surface of a tree, particularly from younger, smaller trees, can exhibit an undesirable rounded, rather than squared, edge. Also, subsequent to milling, lumber can take on moisture or dry out, which causes a board to become warped and unusable for its intended purpose. These faults contribute to 30–35% of conventional lumber being of a downgraded quality rating.

The lumber that remains suitable for use in construction must often be trimmed, shimmed, nailed to fit, or otherwise adapted for use due to inconsistencies in dimensional accuracy. Furthermore, once installed, lumber is subject to dimensional instability due to environmental factors or the other factors mentioned above. For example, in a condition known as nail pop, installed lumber dries out and shrinks, causing fasteners to move or break loose. Likewise, accidental contact with water or moisture can cause wood to swell and permanently warp.

Natural wood used to produce lumber is also becoming more and more scarce, especially in larger sizes, due to the depletion of old growth forests. This scarcity naturally leads to reduction in quality and/or to the rising cost of conventional lumber and of the homes and businesses built with lumber.

This application also relates to cellulosic, composite articles. One type of composite article is a wood composite such as a man-made board of bonded wood elements and/or lignocellulosic materials, commonly referred to in the art by the following exemplary terms: fiberboards such as hardboard, medium density fiberboard, and softboard; chipboards such as particleboard, waferboard, strandboard, OSB, and plywood. Wood composites also include man-made boards comprising combinations of these materials.

Many different methods of manufacturing OSB are known in the art, such as, for example, those described in Chapter 4.3 of the Wood Reference Handbook, published by the Canadian Wood Council, and The Complete Manual of Woodworking, by Albert Jackson, David Day and Simon Jennings, the disclosures of which are hereby incorporated herein by reference.

The first step in producing a wood composite is to obtain and sort the logs, which may be aspen, balsam fir, beech, birch, cedar, elm, locust, maple, oak, pine, poplar, spruce, or combinations thereof. The logs may be soaked in hot water ponds to soften the wood for debarking. Once debarked, the logs are then machined into strands by mechanical cutting means. The strands thus produced are stored in wet bins prior to drying. Once dried to a consistent moisture content, the strands are generally screened to reduce the amount of fine particles present. The strands, sometimes referred to as the filler material, are then mixed in a blending operation, adding a resin binder, wax, and any desired performance-enhancing additives to form the composite raw material, sometimes called the furnish. The resin-coated or resin-sprayed strands are then deposited onto a forming line, which arranges the strands to form a loosely felted mat. The mat, including one or more layers of strands arranged with a selected orientation (including, for example, a random orientation), is then conveyed into a press. The press consolidates the mat under heat and pressure, polymerizing the resin and binding the strands together. The boards are then conveyed out of press into sawing operations which trim the boards to size.

SUMMARY OF THE INVENTION

It is an objective of the invention to overcome one or more of the problems described above.

Accordingly, one aspect of the invention is a composite building component that includes a non-planar molded composite web having two outer zones and two angled zones wherein the caliper of the angled zones differs from the caliper of at least one of the outer zones, and a flange disposed on an outer surface of an outer zone.

Another aspect of the invention is a composite building component including a web having at least one laterally extending channel defined by a first outer zone, a second outer zone, and at least two angled zones, each of the zones having a caliper, and each of the outer zones having an outer surface; a first flange joined to the web at an outer surface of the first outer zone; a second flange joined to the web at an outer surface of the second outer zone; wherein the width of the building component, measured in a direction parallel to a laterally extending channel, is not greater than the thickness of the building component, said thickness measured as a distance between parallel outer surfaces of the flanges.

Other objects and advantages of the invention may become apparent to those skilled in the art from a review of the following detailed description, taken in conjunction with the drawings and the appended claims. While the invention is susceptible of embodiments in various forms, described hereinafter are specific embodiments of the invention with the understanding that the disclosure is illustrative, and is not intended to limit the invention to the specific embodiments described herein.

DETAILED DESCRIPTION OF PREFERRED EMBODIMENTS

Figure 1:
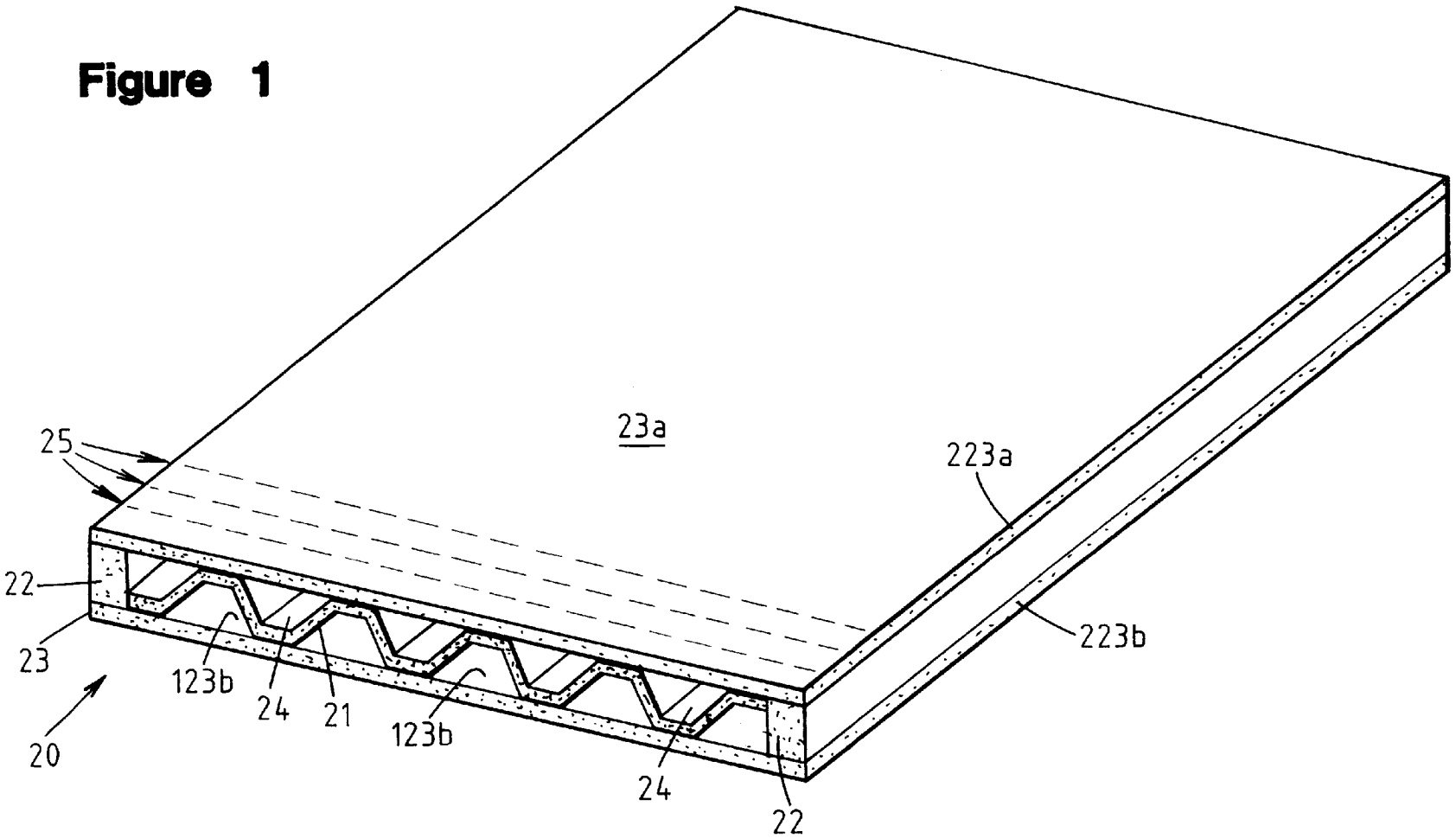
FIG. 1 is an isometric view of a composite building component in accordance with the invention which can be divided to provide multiple lumber or post members.

According to the invention, there is provided a method and apparatus for producing multi-ply or multi-layered composite building components from wood-based materials. The wood-based materials can be, for example, flakes, wafers, particles, fibers, and/or strands, including mixtures thereof. Generally, the building components can be provided by coating or spraying one or more wood-based materials such as flakes or fibers with a resin binder and optionally with a wax and other performance-enhancing fillers to form the composite raw material or furnish. The composite raw material or furnish is formed into a mat of generally uniform basis weight. The mat is loaded into a die set having a desired geometry and consolidated in a heated press to form a composite panel. A die set used to produce a molded or contoured composite panel is described below in detail. Two or more of these panels are bonded together, optionally with one or more end blocks or other framing members, to produce a multi-ply wood composite product of the invention. In a preferred embodiment of the invention, the bonded assembly is subsequently cut into multiple multi-ply wood composite building components.

The multi-ply composite building components of the invention preferably include OSB components made from a raw material obtained by breaking down logs or other source of wood into strands, as described above. Various methods of producing these strands are known in the art. The strands are preferably produced through mechanical slicing and flaking. Exemplary sources of wood materials are: aspen, balsam fir, beech, birch, cedar, elm, locust, maple, oak, pine, poplar, spruce, or combinations thereof. Aspen or pine is preferred, but the wood used will depend upon availability, cost, and special use requirements. The type of wood-based material used will define the type of board and properties produced. For example, the invention can include components defined as flakeboard, waferboard, strandboard, OSB, and/or fiberboard. Oriented strandboard is preferred.

Ranges of exemplary and preferred dimensions of strands for use in a preferred composite panel are described below in Table I.

TABLE I

Preferred Strand Dimensions

| | Length | Width | Thickness |
|---|---|---|---|
| Exemplary range | about 2 inches to about 10 inches (about 5 cm to about 25.4 cm) | about ¼ inch to about 3 inches (about 6 mm to about 76 mm) | about 0.007 inch to about 0.05 inch (about 0.18 mm to about 1.27 mm) |
| Preferred range | about 4 inches to about 6 inches (about 10 cm to about 15 cm) | about ½ inch to about 1½ inches (about 12.7 mm to about 38 mm) | about 0.015 inch to about 0.03 inch (about .38 mm to about .76 mm) |

Once produced as described above, the strands are preferably processed to reduce the level of fine particles and dust. This step is preferably achieved by sending the strands through a rotary screen classifier or by other suitable means. In general, the level of fines can be up to about 60 weight percent (wt. %) (based on total weight of the wood-based material) at an about ⅛ inch (about 3.2 mm) screen size or finer, and more preferably in a range of about 20 wt. % to about 30 wt. %. (Unless otherwise noted, the percentages expressed herein are based upon weight.) The mixture of wood-based material is sometimes referred to simply as wood strands.

The moisture content of the processed strands is preferably in a range of about 2 wt. % to about 9 wt. %, and more preferably in a range of about 4 wt. % to about 6 wt. %, based on the weight of the wood-based material.

The strands (and any accompanying particles and dust) are then mixed in a blending operation, preferably adding a resin binder, wax, and any other desired performance-enhancing additives to form the composite raw material used to produce the boards of the invention. Preferred resin binders include phenolic resins, resorcinol resins, and MDI resins, although many different types of resins can be utilized. Preferably, the resin content is in a range of about 1 wt. % to about 10 wt. % of the weight of the wood-based material, and more preferably in a range of about 3½ wt. % to about 5½ wt. %. When using MDI resins, less resin is generally required than when using phenolic or resorcinol resins. In addition to allowing for reduced resin usage, MDI resins allow for decreased press temperatures (resulting in reduced energy input) and permits the use of raw materials with higher moisture contents.

Ingredients can be added to the raw material to impart various beneficial properties to the composite building components of the invention. For example, waxes, fire retardants, insecticides, fungicides, water repellants, ultraviolet radiation (UV) blockers, pigments, and combinations thereof can all be used in alternative embodiments of the invention. An exemplary fire retardant is sold under the trademark D-BLAZE by Chemical Specialties, Inc., of Charlotte, N.C. Wax is preferably added to improve moisture resistance, preferably in a range of about ½ wt. % to about 2 wt. % of the weight of the wood strands, for example at about 1 wt. %. An exemplary wax is sold under the trademark EW 58 LV by Borden of Diboll, Tex.

The raw material is then continuously deposited on a forming line to form a mat of generally uniform basis weight. In another embodiment of the invention, the mat can be formed individually in a batch process. The basis weight of a mat is calculated as the volume of the molded panel multiplied by the target density of the molded panel divided by the surface area of the formed mat, and has units $lb/ft^2$ or $kg/m^2$.

A continuously-formed mat is then cut to size, having a length and width roughly equal to, or slightly larger than, the length and width of a desired panel produced by a suitable die set. Thus, a consolidated panel is limited in length and width only by the size of the equipment used to produce the panel.

The individual strands in the mat can be imparted a selected orientation (generally in the case of OSB), or the mat can be assembled with strands in random orientation. OSB generally refers to a board produced from a mat wherein the strands are imparted with a specific orientation, but can also refer to a board produced from a mat wherein the strands are imparted with or have a random orientation. Individual strand layers within a single mat can have different orientations. The strand orientation will affect the mechanical performance characteristics of the consolidated composite board, so the preferred strand orientation will differ from application to application.

The mat is then loaded into a die set having the desired geometry. The temperature of the press platens and die set during mat consolidation using a phenolic resin is preferably in a range of about 420° F. to about 480° F. (about 215° C. to about 249° C.), and more preferably about 450° F. (about 232° C.). As will be apparent to those of skill in the art, desirable pressing temperatures and pressures can be modified according to various factors, including the following: the die geometry; the type of wood being pressed; the moisture content of the raw material; the press time; and the type of resin that is utilized. The moisture content of the raw material is one important factor which controls the core temperature of the mat that can be achieved under given press conditions and therefore may control the press cycle. Press time can generally be decreased by increasing press temperature, with certain limitations as is known in the art.

Steam injection pressing is a consolidation step that can be used, for example, under certain circumstances in production of consolidated cellulosic composites. In steam injection pressing, steam is injected through perforated heating press platens and/or die set, into, through, and then out of a mat. The steam condenses on surfaces of the raw material and heats the mat. The heat transferred by the steam to the mat as well as the heat transferred from the press platens and/or die set to the mat cause the resin to cure. When compared with conventional pressing operations, steam injection pressing can, under certain circumstances, provide a variety of advantages, such as, for example, shorter press time, a more rapid and satisfactory cure of thicker panels, and products having more uniform densities.

According to an embodiment of the inventive method, a first mat is consolidated under heat and pressure in an apparatus configured to produce a molded composite web having one or more contoured features (e.g., features referred to as ridges, ribs, channels, projections, flat zones, upper zones, outer zones, or raised zones) upwardly and/or downwardly disposed from a center line or major planar surface of the panel, as described below in greater detail. In an embodiment of the invention which preferably has uniform strength, the projections are preferably evenly spaced. Upon pressing, the panel retains integrity and does not fracture. The panel is then edge-trimmed to size.

Preferred embodiments of the inventive articles generally include multiple OSB components which may or may not have the same configuration and composition. Thus, one or more additional mats are each consolidated under heat and pressure in an apparatus configured to produce a panel having a desired configuration. These additional composite panels can be flat or can have molded or contoured features, and are likewise edge-trimmed to size. These additional composite panels are also described in greater detail below.

One or more of the additional panels are aligned and bonded with the first panel, and optionally with end blocks or other framing members, to form a wood composite building component of the invention. Any suitable adhesive can be used to bond the panels and optional end blocks with each other. A preferred bonding adhesive, applied at the interfaces or joints between panels, will provide a shear strength that is at least about equal to the shear strength of the composite panels themselves. A preferred bonding adhesive can be selected from the group consisting of hot melt polyurethane, moisture curing hot melt polyurethane, moisture curing polyurethane adhesives, and combinations thereof. The adhesive is preferably applied at an amount in a range of about ¼ $oz./ft^2$ of contacting surface area (about 7.4 $ml/cm^2$) to about ¾ $oz./ft^2$ (about 22 $ml/cm^2$), for example about ½ $oz./ft^2$ (about 14 $ml/cm^2$). In an alternative embodiment of the invention, a waterproof resorcinol adhesive or an isocyanate or MDI-based adhesive can be used. In another alternative embodiment, the glue can either be replaced with or assisted by mechanical fasteners, such as staples.

In a preferred embodiment of the invention, the bonded assembly is subsequently cut into multiple wood composite building components, as described below.

The advantageous properties of the inventive product allow it to be an excellent component in building construction applications. This process according to the invention produces a composite component that integrates an engineered combination of various desired properties useful in building components such as compressive and bending strength, bending stiffness, impact deflection, and increased resistance to water, insects, bacteria, and fire.

Various preferred embodiments of the invention will now be described in more detail.

COMPOSITE LUMBER

Figure 9:
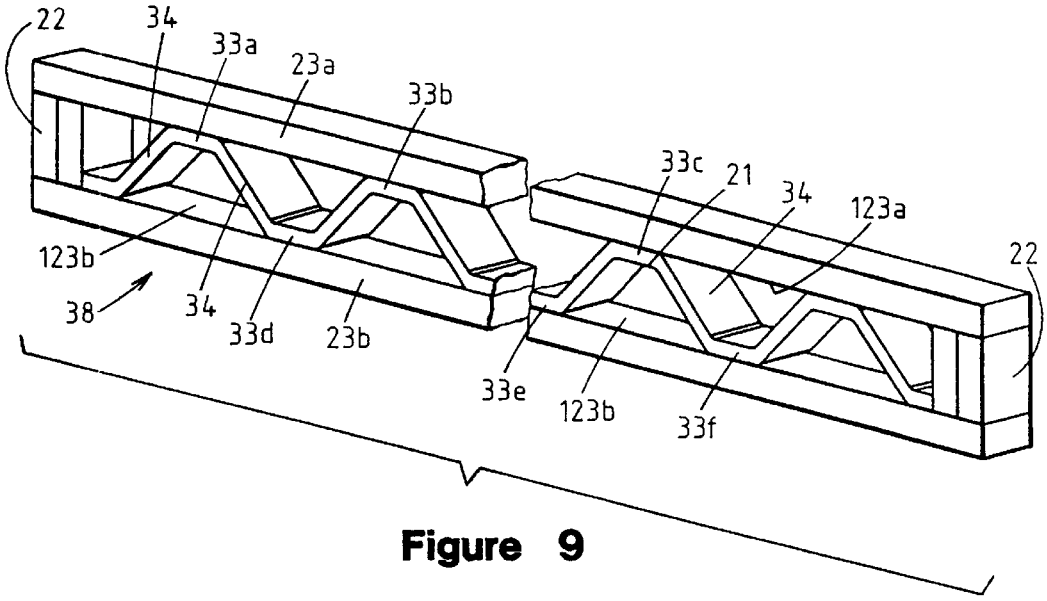
FIG. 9 is a fragmentary isometric view of a composite nominal 2×4 lumber component embodiment of the invention.

The inventive process can be used to produce a composite lumber embodiment of the invention suitable as a replacement for conventional lumber, or an embodiment engineered with dimensions and strength characteristics for specific applications not suitable for conventional lumber. Referring initially to FIG. 1 for an overview of a product produced in accordance with the invention, these inventive multi-ply composites involve a bonded assembly 20 as an intermediate component. The component 20 includes one or more web panels 21 (one shown), and one or more end blocks 22 (two shown) sandwiched between two flanges 23. The flange 23 in FIG. 1 is a flat panel, but this need not be the case. The bonded assembly 20 is preferably cut in a direction perpendicular to channels 24 in the web panel 21 along lines 25 to produce individual multi-ply wood composite lumber members of the invention (see FIGS. 9 and 10), each composite lumber member having one or more webs 21, flanges 23, and optional end blocks 22.

It is to be understood that the terms web, flange, and end block are used to refer to these individual components either as panels and beams in the bonded assembly 20 or as elements of the individual lumber members produced by dividing the bonded assembly 20 along lines 25, as described above and shown in FIG. 1. Thus, although the terms web and web panel are interchangeable, the term web panel can be used to emphasize a relatively larger sized element, e.g., element 21 in FIG. 1, prior to being cut to size as described herein.

In a preferred method of producing a composite lumber product of the invention, the mat which will become the web 21 is formed of up to three layers of resin-coated, loosely felted, oriented strands in the continuous process described above. For example, a first, or bottom, layer is formed in the direction parallel to the longitudinal axis of a finished lumber member. This first layer preferably constitutes about ⅓ to about 100% of the total mat weight. A second, or middle, layer can be formed perpendicular to the direction of the first layer and can comprise up to about ⅓ of the total mat weight. A third, or top, layer can be formed parallel to the first layer and can constitute up to about ½ of the total mat weight. In other words, from one to three layers are preferably included in the mat, wherein each layer generally has strands oriented in a direction perpendicular to the strands in an adjacent layer. In one preferred embodiment, each layer comprises about ⅓ of the total weight of the mat. In another preferred embodiment, about 80% to about 100% of the strands are oriented in the direction parallel to the longitudinal axis of a lumber member, for example about 90% of the strands. In such embodiments, the strands oriented in the direction parallel to the longitudinal axis of a lumber member will be distributed about equally by weight between the top and bottom layers.

In one preferred embodiment, the dimension of the web 21 in the direction perpendicular to the channels 24 will roughly correspond to the desired length of a completed composite lumber product of the invention. In another preferred embodiment, the dimension of the web 21 in the direction perpendicular to the channels will be less than the desired length of the completed composite lumber member of the invention to provide space for optional end block beams 22, as in the embodiment of FIG. 1. In such a case, the web 21 will preferably be bonded-to the flange 23 in such a manner as to leave an approximately equivalent gap at opposing ends of the bonded assembly 20 along lines 25. These embodiments will be discussed in more detail below in conjunction with the end blocks 22.

The width of the web panel 21 (i.e., in the direction perpendicular to the lines 25) and, thus, the mat used to produce web panel 21, is preferably as great as possible to maximize the efficiencies of production of multiple lumber members from one bonded assembly 20. For example, in a 4 foot (about 1.2 m) by 8 foot (about 2.4 m) heated press used to produce composite lumber about 8 feet (about 2.4 m) long, the web panel 21 is preferably about 4 feet (about 1.2 m) wide. Most preferably, an 8 foot (about 2.4 m) by 24 foot (about 7.3 m) heated press is used to produce composite lumber about 8 feet (about 2.4 m) long, with a web panel 21 preferably about 24 feet (about 7.3 m) wide (i.e., in the direction perpendicular to the lines 25).

Figure 2:
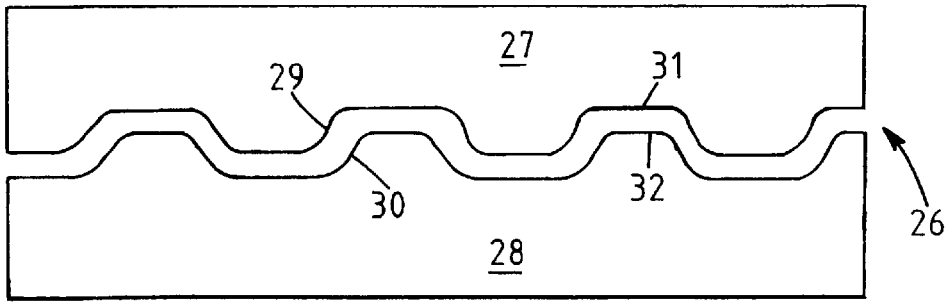
FIG. 2 is a cross-sectional view of a die set used to mold a web core panel used in an embodiment of the invention.

A preferred process for producing an inventive composite lumber article will now be described. Referring to FIG. 2, a loosely felted web mat (not shown), produced as described above, is loaded into a die set 26 having a preferred unique configuration for producing a web panel 21 having parallel channels 24 with sloped sides. The die set 26, including a first (upper) die 27 and a second (lower) die 28, determines the profile geometry of the consolidated web 21.

As the die set 26 is closed on the mat, the wood strands of the mat preferably shift or slide within the matrix of the mat, grossly conforming to the die configuration. It has been found that due to compressing and shearing forces on the mat created by the interaction between the die 27 and the die 28, the surface area of the mat can increase as much as 75 percent, preferably about 15 to about 25 percent, most preferably about 20 percent. Because of the unlocked state of the strands in the loosely felted mat, they generally tend to shift at certain regions of the mat during the compression operation. Factors influencing the amount that the surface area of a mat may increase during pressing using the process of the invention include: the geometry of the channels 24; the variation in caliper among various locations of the web 21; the mat basis weight and orientation of the strands prior to press closure; and the strand geometry (including physical length, width and thickness). These factors affect the ability of the strands to shift or slide within the matrix of the mat before bypassing, fracturing, or destroying the continuity of the composite mat during press closure. The process used and the unique die configuration used according to the invention help to optimally combine these factors so that the surface area of the mat can increase without fracturing the mat at the outer zones 33. At the same time, the process preferably provides a product with approximately constant density throughout its profile, whereas compressed products of prior methods can be undesirably characterized by density variations, resulting in reduced strength of a board.

The temperature of the press platens and/or die set during mat consolidation using a phenolic resin is preferably in a range of about 420° F. to about 480° F. (about 215° C. to about 249° C.), and more preferably about 450° F. (about 232° C.). The pressing time will depend on the caliper of the finished product and the other factors listed above, but is generally in a range of about 1 minute to about 5 minutes in preferred embodiments of the invention.

The caliper of a consolidated web will be defined by a distance or gap between the first die 27 and second die 28 during pressing and consolidation of a mat. For example, the die gap at one location of the die set 26 is defined by the distance between point 29 and point 30 in FIG. 2. Another measurement of die gap can be made at points 31 and 32. As the result of specified variations in the die gap, the die set 26 of the invention will preferably produce a web 21 having a caliper that differs from one point to another (e.g., differing at the locations of the web corresponding to locations 29/30 and 31/32 of the die of FIG. 2) to achieve an at least substantially uniform density throughout the web 21. This aspect of the invention not only maximizes the stiffness properties of the web 21, but also maintains the integrity of the mat during compression.

Figure 3:
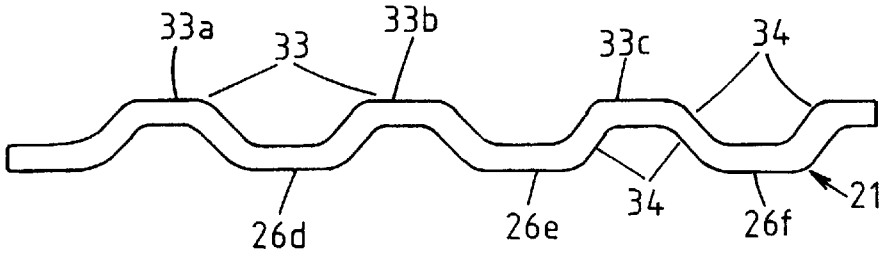
FIG. 3 is a cross-sectional view of a web panel used in an embodiment of the invention.
Figure 4:
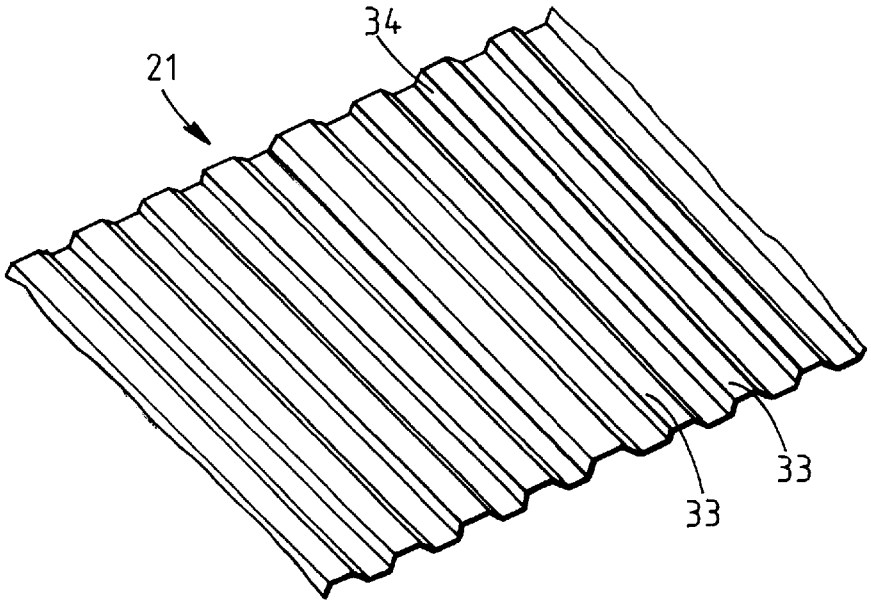
FIG. 4 is an isometric view of a web panel used in an embodiment of the invention.

FIG. 3 illustrates the cross-sectional geometry of a web panel 21 of the invention produced by the die set 26 of FIG. 2. FIG. 4 provides an isometric view of the web panel 21 produced by the die set 26. (Like reference numbers in the figures refer to like elements.) The web panel 21 shown in FIGS. 3 and 4 has (a) multiple generally planar longitudinally extending outer zones 33 and (b) multiple longitudinally extending inner or angled zones 34 that are disposed between, contiguous with, and integrally formed with the outer zones 33. The outer zones 33 are disposed upwardly of (e.g., elements 33*a*, 33*b*, and 33*c* in FIG. 3) and downwardly of (e.g., elements 33*d*, 33*e*, and 33*f* in FIG. 3), contiguous with, and integrally formed with the angled zones 34. An upper surface of the web panel is formed by contact with the first die 27, and a lower surface of the web panel is formed by contact with the second die 28. Adjacent outer zones (e.g., zones 33*a* and 33*d*) are spaced apart laterally a predetermined, preferably equal, distance and vertically a predetermined distance.

Preferably, the caliper of the web 21 at the upwardly disposed outer zones 33*a*, 33*b*, and 33*c* (as shown in FIG. 3) will be less than (thinner than) the caliper of the web 21 at the angled zones 34. The caliper of the web 21 at the downwardly disposed outer zones 33*d*, 33*e*, and 33*f* is preferably greater than the caliper of the web 21 at the upwardly disposed outer zones 33*a*, 33*b*, and 33*c*, and is at least about equal to the caliper of the web 21 at the angled zones 34. These calipers will be provided by setting the die gap, as described above. More specifically, the ratio of the caliper of the upwardly disposed outer zones 33*a*, 33*b*, 33*c* to the calipers of the angled zones 34 and downwardly disposed outer zones 33*d*, 33*e*, 33*f* are preferably in a range of about 0.75 to about 1.0, more preferably in a range of about 0.8 to about 0.9, for example about 0.85. The differing caliper will provide substantial and unexpected advantages in production and use of the web 21 in the building components of the invention. The caliper of the web 21 is preferably in a range of about ⅛ inch to about 1 inch (about 3.18 mm to about 25.4 mm), more preferably in a range of about ¼ inch to about ½ inch (about 6.35 mm to about 12.7 mm). The caliper at the outer zones 33*a*, 33*b*, 33*c* is preferably in a range of about 0.215 inch to about 0.465 inch (about 5.5 mm to about 11.8 mm), while the caliper at the outer zones 33*d*, 33*e*, 33*f* is preferably in a range of about 0.250 inch to about 0.50 inch (about 6.35 mm to about 12.7 mm).

The web panel 21 according to the invention preferably has a specific gravity in a range of about 0.6 to about 0.9 at any location in the panel, more preferably about 0.65 to about 0.75, most preferably about 0.75 when using southern yellow pine. The overall specific gravity of the panel is preferably in a range of about 0.6 to about 0.9, more preferably about 0.65 to about 0.75, most preferably about 0.75 when using southern yellow pine, making it a high density wood composite. The varying die gap preferably allows for the production of a web panel 21 having an at least substantially uniform density throughout its profile. Preferably, the density of the web 21 at an outer zone 33 is at least about 75% of the density of the web 21 at an angled zone 34, more preferably at least 90%, for example 95%. Likewise, the density of the web 21 at an upwardly disposed outer zone (e.g., 33*a*) preferably is at least about 75% of the density of the web 21 at a downwardly disposed outer zone (e.g., 33*d*), more preferably 80%, most preferably at least about 90%, for example 95%.

Figure 5:
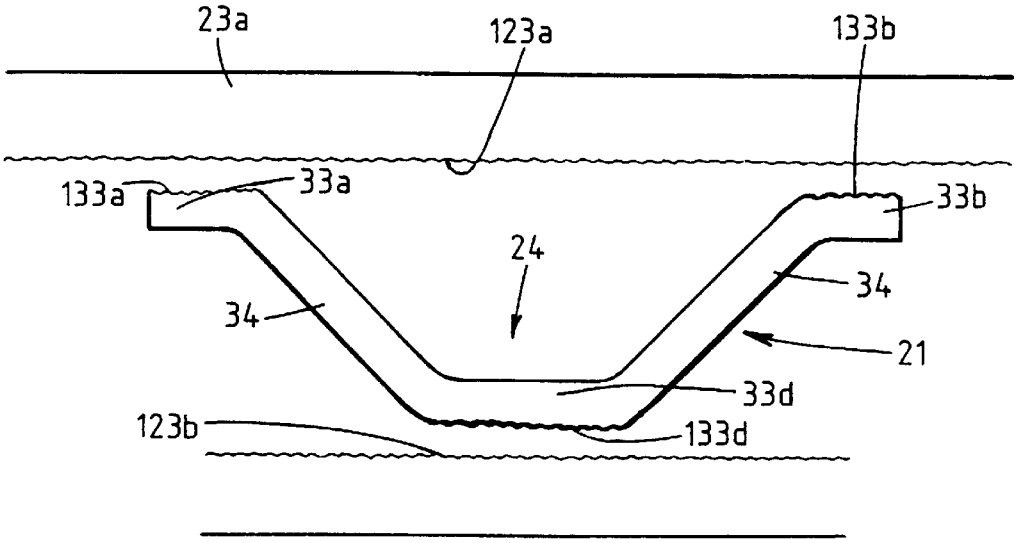
FIG. 5 is a side elevation with portions removed of a web panel and flange panels with interlocking geometry used in an embodiment of the invention.

While the outer zones 33 of the web panel 21 shown in FIGS. 3 and 4 are generally flat (planar), in an alternative embodiment the outer zones 33 can have contours or other deviations from a planar configuration. For example, a texture or contour can be provided on outside surfaces of the outer zones 33 of the web 21 to provide improved interlock or bonding (interlocking geometry texture) with other components of the final lumber product, such as a flange, end block, or additional web. For example, FIG. 5 is a partial profile view of a web 21 and flanges 23*a* and 23*b* having one type of interlocking geometry texture. A bottom surface 133*d* of the zone 33*d* has a texture that permits improved adhesion with a textured upper surface 123*b* of the flange 23*b*. Thus, it is understood that the use of the term flat herein refers to a generally planar portion. In another alternative embodiment, an outer zone 33 can be the peak of a curved portion of the web 21. In yet another embodiment, an outer zone 33 can have a caliper that increases or decreases from the center of the zone 33 to the end of the zone 33 which is contiguous with, and integrally formed with an angled zone 34.

Figure 6:
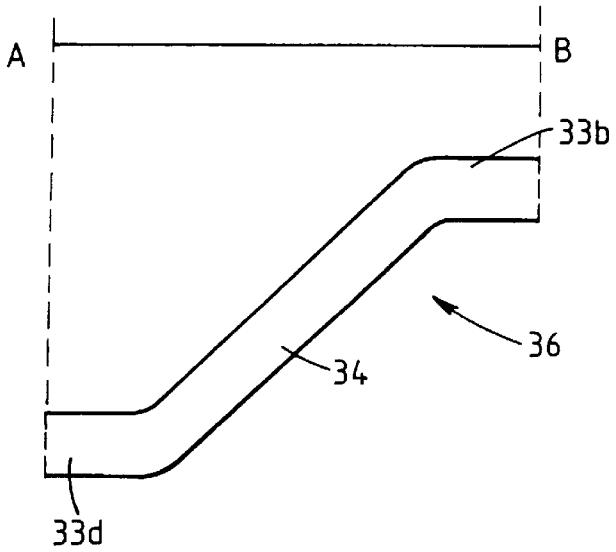
FIG. 6 is a side elevation of a segment of web panel used in an embodiment of the invention.

Likewise, the angled zones 34 shown in FIG. 3 are generally flat (planar) (as also shown in FIGS. 5 and 6), but can also have contours. For example, a web 21 can have a cross section in the shape of a sinusoidal curve. In an even further embodiment, the angled zones 34 shown in FIG. 3 can incorporate one or more flat zones which are substantially perpendicular to the outer zones 33 of the web 21. In yet another embodiment, an angled zone 34 can have a caliper that increases or decreases from the center of the zone 34 to the end of the zone 34 which is contiguous with, and integrally formed with an outer zone 33.

The angled zones 34 can form various angles with the outer zones 33. These angles, which can be referred to as draft angles, preferably are in a range of about 30 degrees to about 60 degrees, more preferably in a range of about 35 degrees to about 55 degrees, and most preferably in a range of about 40 degrees to about 50 degrees, for example about 45 degrees in a preferred composite lumber article.

Figure 7:
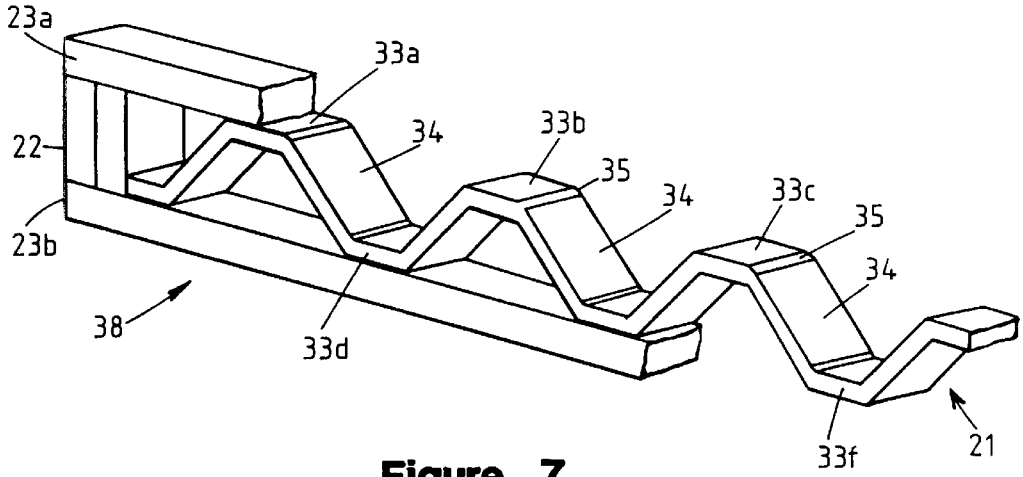
FIG. 7 is a cut-away isometric view of a portion of a composite nominal 2×4 lumber component embodiment of the invention.

Referring to FIG. 7, there is shown a composite lumber article of the invention 38 having upper and lower flanges 23*a* and 23*b*, respectively, a web 21 sandwiched between the flanges 23, and an optional end block 22. A radius 31 is defined as the curvature of the web 21 at an intersection of the outer zone 33 and the angled zone 34. The radius 35 of the web 21 at the angles formed between the angled -zones 34 and the outer zones 33 generally varies with the caliper of the upwardly disposed outer zones 33. Table II below summarizes the preferred approximate radii of the web 21 for various calipers of the outer zone 33.

TABLE II

Preferred Web Radii (Approximate Values)

| Caliper of Upwardly Disposed Outer Zone 33 | Preferred radius |
|---|---|
| 0.125 in. (3.175 mm) | 0.1875 in (4.76 mm) |
| 0.25 in. (6.35 mm) | 0.3125 in (7.93 mm) |
| 0.375 in. (9.525 mm) | 0.4375 in (11.1 mm) |
| 0.5 in. (12.7 mm) | 0.5625 in (14.3 mm) |
| 0.625 in. (15.875 mm) | 0.6875 in (17.5 mm) |
| 0.75 in. (19.05 mm) | 0.8125 in (20.6 mm) |

The profile thickness of the web 21 (measured by the greatest depth of the web, for example, the distance from a top surface 133*a* of zone 33*a* to bottom surface 133*d* of zone 33*d*) is preferably in a range of about ¼ inch to about 8 inches (about 6.35 mm to about 20.32 cm), and more preferably in a range of about ¼ inch to about 4 inches (about 6.35 mm to about 10.16 cm).

The depth of draw of a web 21 is measured as the vertical distance traveled by an angled zone 34 between the center lines of adjacent outer zones (e.g., the zones 33*a* and 33*d*). Whereas the depth of draw can be uniform throughout a web 21, this need not be the case. Thus, for example, the top surfaces of the outer zones 33*a*, 33*b*, and 33*c* are preferably, but optionally, in a single plane. The depth of draw of the web 21 is preferably about 6 inches (about 15.24 cm) or less, and more preferably in a range of about ¼ inch to about 3½ inches (about 6.35 mm and about 88.9 mm). In one embodiment of the invention, the depth of draw of the web 21 is greater than the caliper of any zone.

A web segment 36, depicted in FIG. 6, is defined as a portion of a web 21 between a longitudinal midpoint of a downwardly disposed outer zone 33 and the longitudinal midpoint of an adjacent upwardly disposed outer zone 33 (e.g. midpoint of 33*d* to midpoint of 33*b*). This distance (measured along the line segment A-B shown in FIG. 6) will depend on the draft angle of the angled zone 34, the depth of draw in the web segment 36, and the lengths of the downwardly disposed outer zone 33*d* and the upwardly disposed outer zone 33*b*. In a web 21 in which all web segments 36 are identical, the frequency of web segment 36 repeat is defined as the inverse of the length of the web segment 36.

The strength properties of composite lumber articles will depend in part on the frequency of web segment 36 repeat. In general, as the frequency of web segment 36 repeat increases, the deflection strength of the lumber article increases. The following design factors interrelate to provide deflection resistance of a web, and therefore to an article including the web: (a) length of the lumber desired; (b) width of end block 22 used (if any); (c) draft angle of angled zone 34 (which itself will depend on the raw material used and the depth of draw); (d) web 21 caliper, including caliper at the radii and various zones; (e) web 21 density; and (f) area of interface between web 21 and flange 23. These factors can be selected so as to achieve a desired deflection resistance.

Referring to FIG. 1, one or more consolidated web panels 21 are bonded with two flange panels 23 and optionally with two end block beams 22 to form the bonded assembly 20 of FIG. 1. In general, the flange panels 23 of a composite lumber product of the invention can be made from any material. Exemplary flange materials are: laminated veneer lumber (LVL), solid conventional lumber, plywood, laminated strand lumber (LSL), parallel strand lumber (PSL), particle board, OSB, strand board (wafer board), fiberboard, corrugated board, kraft paper, plastics, fiberglass, and metals. The flange material can optionally include performance-enhancing materials such as those described above in relation to the web 21.

The flange 23 also contributes to the deflection resistance of a composite lumber product. Thus, the flange is preferably made from a material that, in combination with the web, provides the desired deflection resistance for a particular application. In one preferred embodiment of the invention, the flanges are OSB, made from the same raw material as the web 21 according to the methods described above. In such an embodiment, the strands of the flange 23 are preferably oriented substantially in the direction perpendicular to the channels 24 of the web 21, and the caliper of the flange 23 is preferably in a range of about ⅛ inch to about 1 inch (about 3.2 mm to about 25.4 mm). The opposing flanges are preferably of about equal caliper, however, the inventive articles can use two completely different flanges (both with respect to caliper and material) in certain applications.

The flange 23 of the lumber article preferably is generally planar with a uniform cross-sectional dimension (or caliper). However, it is to be understood that other flange configurations are useful with the invention. For example, in one alternative embodiment, the flange 23 itself is a web having one or more of the characteristics described above. Preferably, such a web has a relatively small depth of draw [e.g., in a range of about 1/16 to about ½ inch (about 1.6 mm to about 12.7 mm)] and a frequency of web segment 36 repeat and outer zone 33 lengths sufficient such that one or more outer zones 33 of the flange panels 23 come into contact with one or more outer zones 33 of the web 21 panels.

Preferably, the flange 23 panels will have one dimension, referred to hereafter as length, which is approximately equal to the length of the desired composite lumber article. Referring to FIG. 1, depicting a bonded assembly 20, the length of flange 23 panels is measured along lines 25. The dimension of the flange panels 23 in the planar perpendicular direction (width) can be any practical size, and will preferably be about equal to the width of the web 21 panel in the bonded assembly 20.

In general, an optional end block 22 of the composite lumber article of the invention can be made from any material or combinations of materials, including laminated veneer lumber (LVL), solid conventional lumber, plywood, laminated strand lumber (LSL), parallel strand lumber (PSL), particle board, OSB, strand board (wafer board), fiberboard, corrugated board, kraft paper, plastics, fiberglass, and metals. Preferably, the end block 22 will be constructed of nailable material. In one preferred embodiment of the invention, an end block 22 is constructed from particleboard. In another preferred embodiment of the invention, an end block 22 is constructed from the offstock of flange production. Preferably, opposing end blocks are made from the same materials, however, the invention can use two different materials as end blocks in the same article.

An optional end block beam preferably has a length roughly equivalent to the width of the flange panels 23 (which is roughly equivalent to the width of the web panel 21).

An optional end block 22 preferably has a width sufficient to span a predetermined gap between outer edges 223*a* and 223*b* of flange panels 23*a* and 23*b* and the end of a web panel 21 (not visible) on each end of the bonded assembly 20, as shown in FIG. 1. Preferably, the end block 22 will be sufficiently large to provide an adequate volume of solid material to hold a mechanical fastener when the lumber is installed using mechanical fasteners.

An optional end block 22 beam preferably will be sufficiently large to span a gap formed between inner faces 123*a* and 123*b* of opposing flanges 23*a* and 23*b* in the bonded assembly 20. In a composite lumber article of FIG. 1 wherein the length of a web 21 in the direction perpendicular to the channels along lines 25 is less than the length of flanges 23 along lines 25, the end block 22 beam thickness is preferably about equal to the profile depth of the web panel 21. In another embodiment, the length of a web panel 21 in the direction along the lines 25 is roughly equal to the length of the flange 23 panels (wherein a zone 33 of the web 21 extends to the outer edges 223*a* and 223*b* of the flanges 23). In such an embodiment, a preferred end block 22 will have a thickness about equal to the profile thickness of the web 21, less the caliper of the terminal outer zone 33. In other words, in such an embodiment the end block will have a thickness no larger than the gap formed between the inner surface of the outer zone 33 of the web 21 and the inner surface (e.g., 123*a*) of the opposing flange 23.

Figure 10:
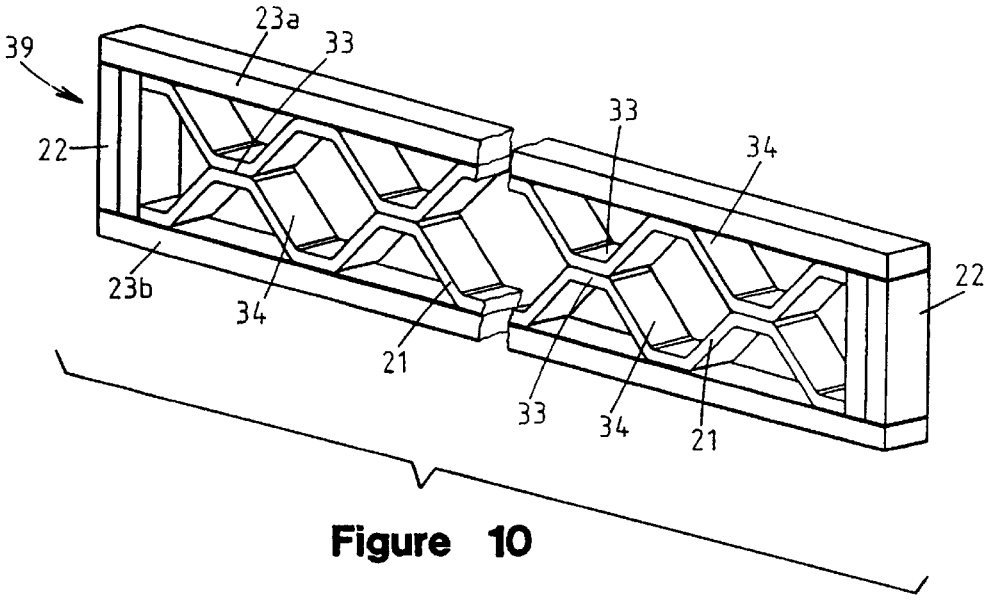
FIG. 10 is a fragmentary isometric view of a composite nominal 2×6 lumber component embodiment of the invention.

To assemble a preferred intermediate bonded assembly 20, bonding adhesive is applied to the interfaces between components, and the components are aligned. For example, adhesive can be applied to the outer surfaces 133*a* and 133*b* (FIG. 5) of outer zones 33 of one or more web panels 21. Where two or more web panels are utilized, preferably the outer zones 33 are aligned such that the channels are parallel and the outer surfaces of the outer zones 33 coincide, for example as shown in FIG. 10. The web 21 panel(s) can be stacked to form the web core, which can be aligned with a flange 23 panel and bonded thereto. Optional end blocks 22 can be bonded to the flange panels 23 and web panel(s) 21 at the ends of the web 21 panel(s), parallel to the channels 24. A second flange panel can be aligned with and bonded to the web 21 panel and optional end block 22 beams.

Subsequent to application of the bonding adhesive and alignment of the components, the entire bonded assembly 20 is conveyed into a press, preferably a continuous nip press or a platen press, and subjected to elevated pressure and/or temperature sufficient to cure and/or dry the adhesive.

To produce a composite lumber article, the bonded assembly 20 is then conveyed to a multiple-arbor saw. The saw cuts the bonded assembly 20 in the direction perpendicular to the channels 24, along the lines 25. The width between the arbors is about equal to the width of the desired composite lumber articles, for example about 1½ inches (about 3.81 cm), the width of a nominal 2×4. Using this method, multiple multi-ply wood composite lumber embodiments of the invention can be produced from a single bonded assembly 20.

Figure 8:
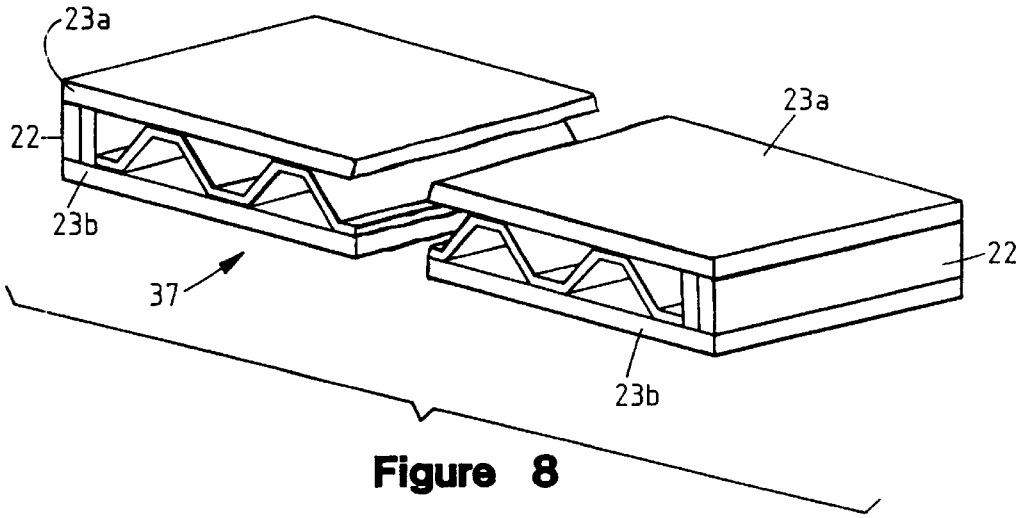
FIG. 8 is a fragmentary isometric view of a composite support post embodiment of the invention.

A support post 37, one example of which is depicted in FIG. 8, can be produced from the same intermediate bonded assembly 20 used for composite lumber by simply cutting a thicker section, for example about 1 foot (about 30.5 cm), from the bonded assembly 20, preferably in the direction perpendicular to the channels 24. In this manner, a support post 37 having a width of about 1 foot (about 30.5 cm) can be produced with the same efficiencies of composite lumber. This is an advantage over known methods in which, for example, eight conventional 2×4s are glued or otherwise fastened together to produce a support post with the same dimensions.

Added performance such as coloring and resistance to fire, insects, bacteria, and water can also be achieved by the addition of suitable performance-enhancing additives or by the application of suitable specialty coatings to the surface of the composite lumber articles of the invention.

Composite lumber embodiments of the invention can be designed to have the same outer dimensions as conventional lumber and modulus of elasticity and moment of inertia sufficient to meet construction requirements for typical applications. However, the invention is also applicable to the production of lumber components having alternative cross sectional dimensions, and in lengths limited only by the size of the equipment used to produce the individual components of the assembly 20.

Furthermore, the invention can also provide composite lumber articles having performance characteristics that differ from their conventional lumber counterparts. For example, conventional 2×6 (nominal) lumber is frequently used in building construction to provide a 5½ inch (about 14 cm) deep space for R-19 insulation between sheathings, but is typically much stronger than necessary to meet building code requirements, thereby increasing the cost of a construction project. A multi-ply wood composite of the invention nominally measuring 2×6 may have the same cross-sectional dimensions as a conventional 2×6, but can be engineered to specific (e.g., increased or decreased compared to conventional wood lumber) strength requirements. Thus, one advantage of the invention is the ability to provide a building component that meets or exceeds the building code requirements but, among other advantages, uses less starting material, weighs less, and is less expensive to produce than a conventional article, such as a conventional 2×6.

Example of Nominal 2×4 of the Invention

An example of a preferred composite product of the invention (shown in an isometric view in FIG. 9) suitable as a replacement for conventional 2"×4"×8' (nominal) conventional lumber includes one web 21 and two end blocks 22 sandwiched between and bonded with two flanges 23. A preferred composite 2×4 article 38 of the invention is designed to have the same cross-sectional dimensions as conventional 2×4 lumber, namely 1½ inches by 3½ inches (about 38.1 mm by about 88.9 mm), a length of about 8 feet (about 244 cm), and a modulus of elasticity that allows the product to meet construction and safety standards for Housing and Urban Development (HUD) manufactured home construction for Wind Zone 1 construction. However, the invention is also applicable to the production of other multi-ply wood composite replacements for conventional lumber, including actual and nominal 1×3s, 1×4s, 2×3s, 2×6s, 2×8s, 2×10s, 2×12s, 4×4s, 4×6s, and 6×6s, for example, and in lengths limited only by the size of the equipment used to produce the individual components of the assembly 20. For example, FIG. 10 is a perspective view of a multi-ply composite 2×6 article 39, which can serve as a replacement for a conventional nominal 2×6. This embodiment of the invention incorporates two web 21 panels bonded at their outer zones 33.

The construction of a preferred 2×4 article 38 of the invention will now be described. A preferred web 21 can be made from strands having a length in a range of about 4½ inches to about 5½ inches (about 11.4 cm to about 14 cm), width in a range of about ¾ inch to about 1 inch (about 19 mm to about 25.4 mm), and thickness in a range of about 0.02 inch to about 0.025 inch (about 0.51 mm to about 0.64 mm). The strands utilized in a preferred web 21 have a pre-pressing moisture content in a range of about 2% to about 9%, preferably in a range of about 4% to about 6%, for example about 5%, based upon weight of the strands.

The mat is produced as described above by combining strands, resin binder, and a wax. A preferred resin binder for the web 21 is a resorcinol resin, preferably added at about 4½ wt. % based upon the weight of the wood strands. Wax is preferably added to the raw material in a range of about ½ wt. % to about 2 wt. %, for example about 1½ wt. %, based upon the weight of the wood strands.

In a preferred 2×4 embodiment, the mat which will become the web 21 is formed of three layers of raw material including strands, according to the continuous process described above. The strands of the first (bottom) and third (top) layers are oriented in the machine direction (i.e., in the direction perpendicular to channels 24) and comprise about 90% of the total mat weight, divided about equally between the two layers. The strands of the second, or middle, layer are oriented perpendicular to the machine direction (i.e., in the direction parallel to channels 24) and comprise the remainder, about 10%, of the total mat weight.

The composite 2×4 articles of the invention are preferably made having lengths of about 81.75 inches (about 2.08 m), about 87.75 inches (about 2.23 m), or about 96 inches (about 2.44 m), to correspond to lengths typically used in construction industries. One type of preferred web 21 for use in the above articles will have lengths of about 81.75 inches (about 2.08 m), about 87.75 inches, (about 2.23 m) or about 96 inches (about 2.44 m), respectively. In an alternative web embodiment, the preferred lengths will be about 78.75 inches (about 2 m), about 84.75 inches (about 2.15 m), or about 93 inches (about 2.36 m), respectively to provide an approximately 1.5 inch (about 3.8 cm) space at each end for end blocks.

The width of the web panel (and, thus, the mat used to produce the web) is preferably as great as possible to maximize the efficiencies of production of multiple lumber members from one bonded assembly 20. For example, in a 4 foot by 8 foot (about 1.22 m by 2.44 m) heated press used to produce composite 2×4 lumber about 8 feet (about 2.44 m) long, the web panel is preferably about 4 feet (about 1.22 m) wide. Most preferably, an 8 foot (about 2.44 m) by 24 foot (about 7.32 m) heated press is used to produce composite 2×4 lumber about 8 feet (about 2.44 m) long, with a web panel preferably about 24 feet (about 7.32 m) wide.

The temperature of the press platens during mat consolidation using a phenolic resin is preferably about 450° F. (about 232° C.). The pressing time will depend on the caliper of the finished product and the other factors listed above, but is generally in a preferred range of about 2.5 minutes to about 3 minutes for a preferred web of the invention for use in 2×4 applications.

The web panel 21 according to the invention preferably has a specific gravity in a range of about 0.6 to about 0.9 at any location in the panel, preferably about 0.75. The overall specific gravity of the panel is preferably in a range of about 0.6 to about 0.9, for example 0.75, making it a high density wood composite. The varying die gap preferably allows for the production of a web panel 21 having an at least substantially uniform density throughout its profile. Preferably, the density of the web 21 at an outer zone 33 is at least about 75% of the density of the web 21 at an angled zone 34, more preferably at least 90%, for example 95%. Likewise, the density of the web 21 at an upwardly disposed outer zone (e.g., 33*a*) preferably is at least about 75% of the density of the web 21 at a downwardly disposed outer zone (e.g., 33*d*), more preferably 80%, most preferably at least about 90%, for example 95%.

The caliper of the web 21 of the article 38 is preferably in a range of about ¼ inch to about ½ inch (about 6.35 mm to about 12.7 mm). The caliper of the angled zones 34 is preferably greater than that of the upwardly disposed outer zones 33*a*, 33*b*, and 33*c*. The caliper of the downwardly disposed outer zones 33*d*, 33*e*, and 33*f* is preferably at least about equal to that of the angled zones 34. In the article 38 of FIG. 9, the caliper of downwardly disposed outer zones 33*d*, 33*e*, 33*f* and the angled zones 34 is about 0.375 inch (about 9.52 mm) and the caliper of the upwardly disposed outer zones 33*a*, 33*b*, 33*c* is preferably about 0.340 inch (about 8.64 mm).

The outer zones 33 of the web 21 preferably have a length of about 6 inches (about 15.24 cm) or less, or about 2 inches (about 5.08 cm) or less, for example about 1.1688 inches (about 2.97 cm). The outer zone 33 of the web 21 can be longer than 2 inches in special applications. The draft angle of the web 21 of the article 38 is preferably about 45 degrees.

The flanges 23*a* and 23*b* of the article 38 preferably are OSB, made from the same raw material as the web 21 and oriented with the strands substantially perpendicular to the channels of the web 21 (i.e. along the length of the article 38). The flange 23 will preferably have a length of about 8 feet (about 2.43 m). The caliper (thickness) of the flange 23 is preferably in a range of about ⅛ inch to about 1 inch (about 3.18 mm to about 25.4 mm), and more preferably in a range of about ½ inch to about 1 inch (about 1.27 cm to about 2.54 cm), for example about 0.75 inches (about 1.9 cm) in a preferred 2×4 flange embodiment.

In one preferred embodiment of the invention, an end block 22 is constructed from the offstock of flange 23 production. The end block 22 width (measured in FIG. 1 in the direction parallel to lines 25) is preferably in a range of about 1 inch (about 2.54 cm) to about 3 inches (about 7.62 cm), for example about 1½ inches (about 3.8 cm), achieved by bonding two segments of flange 23 stock together (as shown in FIGS. 7–10), wherein the flange 23 stock is about ¾ inches (about 1.9 cm) thick. The end block 22 thickness is preferably about 2 inches (about 5.08 cm), about equal to the profile depth of the web 21.

The web panel 21, flange panels 23, and end block 22 are then assembled and bonded according to the method described above to form a bonded assembly 20, as shown in FIG. 1. In a preferred 2×4 article of the invention produced according to the, description above, the bonding adhesive will have a minimum shear strength of about 400 lb/in$^2$ (about 28.1 kg/cm$^2$).

The bonded assembly 20 then is conveyed to a multiple-arbor saw. The saw cuts the bonded assembly in the direction perpendicular to the channels 24 of the web 21 along lines 25 of FIG. 1, as described above.

The composite 2×4s of the example are designed to meet construction specifications for applications in which conventional 2×4s are used as studs. In a preferred 2×4 embodiment, the flange 23 will have a minimum modulus of elasticity of about 900,000 lb/in$^2$. For example, in a test method described by Fleetwood Enterprises, Inc., of Riverside, Calif. and HUD standards, a nominal 2×4 is supported at the top and bottom (in contact with the side measuring 1½ inches (3.8 cm)) and an evenly distributed load is applied over the length of the member. To pass a "live load" test, a 2×4 will not break immediately after application of 2½ times the "live load." To pass a deflection test, the 2×4 must not be displaced at the midpoint more than a maximum allowable deflection value. The live load (in units of pounds) is determined by the wind load, which is about 15 lb/ft$^2$ (73 kg/ml) multiplied by the length of the lumber member and multiplied by the distance that the studs are spaced apart in a wall. The allowable deflection is determined by the 2×4 length divided by 180. For example, for a 2×4 having length of about 81.75 inches (about 2.08 m) and spaced apart about 16 inches (about 40.64 cm), the live load is about 136 pounds (about 61.7 kg) and the allowable deflection is about 0.45 inch (about 11.43 mm); for a 2×4 having length of about 87.75 inches (about 2.23 m) and spaced apart about 16 inches (about 40.64 cm), the live load is about 146 pounds (about 66.3 kg) and the allowable deflection is about 0.49 inch (about 12.45 mm); and for a 2×4 having length of about 96 inches (about 2.44 m) and spaced apart about 16 inches (about 40.64 cm), the live load is about 160 pounds (about 72.6 kg) and the allowable deflection is about 0.53 inch (about 13.46 mm).

Building components made according to the invention exhibit many improved attributes. First, the invention provides consistency in sizing accuracy of building components, both initially and over time. The building. components of the invention also require less material input than their conventional lumber and sheathing counterparts. The building components of the invention can weigh less than their conventional lumber and sheathing counterparts. Because the building components of the invention weigh less than their conventional lumber and sheathing counterparts, they can be shipped in larger sizes. Moreover, because the building components of the invention are dimensionally consistent and can be shipped in larger sizes, less labor is required to assemble the components in construction of a building. In addition, the invention can provide a product with increased surface friction to facilitate usage.

Larger distances can be spanned while using fewer supporting members because the building components of the invention can be engineered to be stronger than their conventional lumber counterparts. The composite lumber embodiments of the invention are able to provide built-in voids suitable to accommodate wiring and piping, which eliminates the labor involved in drilling conventional lumber for the same purpose. Moreover, the multi-ply building components of the invention provide built-in voids which increase the thermal and acoustic insulating efficiency of the components. The invention also provides for the ability to engineer building components with built-in properties such as custom pigmentation and resistance to fire, insects, water, UV radiation, and bacteria. The building components of the invention are also environmentally friendly because they allow for more thorough usage of timber, allow for the usage of lower-quality timber, and can be ground up and easily disposed of or reused. Finally, the invention provides for great efficiencies of production whereby many pieces of composite lumber can be produced at once in assembly-line fashion, and whereby many of the same operations can be used to produce different building components such as composite lumber and support posts.

The foregoing detailed description is given for clearness of understanding only, and no unnecessary limitations should be understood therefrom, as modifications within the scope of the invention will be apparent to those skilled in the art.

What is claimed is:

1. A method of producing a plurality of composite building components, said method comprising the steps of:

(a) forming a mat having first and second major surfaces comprising a wood-based material;

(b) providing the mat in a die set, said die set having a non-planar configuration with at least two outer zones and at least two angled zones;

(c) closing the die to form a die gap, wherein the die gap at at least one of the outer zones differs from the die gap at the angled zones;

(d) consolidating said mat under pressure and heat to form a molded composite web having first and second major surfaces;

(e) joining said web with a first flange at the first major surface of a first outer zone;

(f) joining said web with a second flange at the second major surface of a second outer zone; and (g) dividing the product of step (f) into a plurality of composite building components, each of said components comprising a fraction of said web, a fraction of said first flange, and a fraction of said second flange.

2. The method according to claim 1 wherein the wood-based material comprises wood strands.

3. The method according to claim 2 wherein said wood-based material comprises strands having lengths of about 4 inches to about 6 inches.

4. The method according to claim 1 wherein the die gap at one outer zone is less than the die gap at the angled zones.

5. The method according to claim 4 wherein the die gap at one outer zone is at least about equal to the die gap at the angled zones.

6. The method according to claim 1 wherein the ratio of the die gap at an outer zone to the die gap at the angled zones is in a range of about 0.8 to about 0.9.

7. The-method according to claim 1 wherein the surface area of the molded composite web is up to about 75% greater than the surface area of the mat.

8. The method according to claim 7 wherein the surface area of the molded composite web is about 15% to about 25% greater than the surface area of the mat.

9. The method according to claim 2 wherein the wood strands shift within the matrix of the mat to grossly conform to the die configuration in step (c).

10. The method according to claim 1 wherein said molded composite web has at least one channel defined by a first outer zone, a second outer zone, and at least two angled zones.

11. The method of claim 1, further comprising the step of joining at least one of said web and a flange with an end block prior to said dividing step.

12. The method of claim 10, further comprising the step of joining at least one of said web and a flange with an end block prior to said dividing step.

13. The method of claim 10, wherein said molded composite web comprises a plurality of channels.

14. The method of claim 10, wherein said dividing step comprises dividing the product of step (f) in a direction perpendicular to said channel.

15. The method of claim 1, wherein the depth of draw of the molded composite web is greater than the die gap at any zone.

16. The method of claim 1, wherein at least one flange comprises a wood-based material.

17. The method of claim 1, further comprising the step of providing a major surface of an outer zone with an interlocking geometry texture.

18. The method of claim 17, further comprising the step of providing a flange with an interlocking geometry texture at a major surface.

19. The method of claim 1, wherein said dividing step provides a plurality of composite building components wherein the width of each component is equal to or less than the thickness of each component, said thickness measured as a distance between parallel outer surfaces of said flanges.

20. The method of claim 1, wherein said forming step comprises forming a mat comprising wood-based strands in random orientation.

21. The method of claim 1, wherein said forming step comprises depositing a first layer comprising wood-based strands oriented in a direction parallel to the longitudinal axis of a divided composite building component to be formed, depositing a second layer comprising wood-based strands oriented perpendicular to the direction of said first layer, and depositing a third layer comprising wood-based strands oriented parallel to said first layer.

22. The method of claim 21, wherein said forming step comprises depositing at least about 80% of said strands oriented in a direction parallel to the longitudinal axis of a divided composite building comnponent to be formed.

23. The method of claim 1, wherein said forming step comprises continuously depositing said wood-based material on a forming line and further comprising the step of cutting said continuously-formed mat to size prior to said providing step.

24. The method of claim 1, wherein said providing step comprises loading said mat into said die set without the use of a caul sheet.

25. The method of claim 1, wherein said molded composite web has an at least substantially uniform density.

26. The method of claim 25, wherein the density of said web at an outer zone is at least about 90% of the density of said web at an angled zone.

27. The method of claim 7, wherein the mat has a generally uniform basis weight.

* * * * *